US007307920B2

(12) United States Patent
Su

(10) Patent No.: US 7,307,920 B2
(45) Date of Patent: Dec. 11, 2007

(54) TIMER DISPLAY DEVICE HAVING LIGHT GENERATING MODULE WITH CIRCULAR ARRANGEMENT

(75) Inventor: Hwa Su, Taipei (TW)

(73) Assignee: Intematix Technology Center Corp., Taoyuan County (TW)

( * ) Notice: Subject to any disclaimer, the term of this patent is extended or adjusted under 35 U.S.C. 154(b) by 22 days.

(21) Appl. No.: 11/236,506

(22) Filed: Sep. 28, 2005

(65) Prior Publication Data

US 2006/0262654 A1 Nov. 23, 2006

(30) Foreign Application Priority Data

May 17, 2005 (TW) ..... 94207983 U

(51) Int. Cl.
*G04C 19/00* (2006.01)
*G04C 17/02* (2006.01)

(52) U.S. Cl. ..... 368/82; 368/239; 368/240

(58) Field of Classification Search ..... 368/82–85, 368/239–242, 223
See application file for complete search history.

(56) References Cited

U.S. PATENT DOCUMENTS 3,922,847 A * 12/1975 Culley et al. ..... 368/240
4,007,583 A * 2/1977 Johnson ..... 368/29
4,081,953 A * 4/1978 Crutcher ..... 368/85
4,702,615 A * 10/1987 Havel ..... 368/82
6,683,822 B2 * 1/2004 Cheng ..... 368/240

* cited by examiner

*Primary Examiner*—Vit W Miska
(74) *Attorney, Agent, or Firm*—Rosenberg, Klein & Lee

(57) ABSTRACT

This utility discloses a timer display device for displaying time. The timer display device comprises a counting unit and at least twelve light generating modules with circular arrangement to hour positions. The counting unit is a clock for counting actual time. The light generating module is used to modify light generating status according to the counting unit to display actual time correspondingly.

10 Claims, 8 Drawing Sheets

TIMER DISPLAY DEVICE HAVING LIGHT GENERATING MODULE WITH CIRCULAR ARRANGEMENT

FIELD OF THE INVENTION

This utility generally relates to a timer display device, more particularly relates to a timer display device having light generating modules with circular arrangement.

BACKGROUND OF THE INVENTION

Time display usually includes clocks and watches for displaying an accurate time. Referring to FIG. 1, a block diagram of a conventional timer display device is illustrated. The timer display device comprises an hour hand 11, a minute hand 12, a second hand 13, and a plurality of time symbols 14 that arrange in circular to an hour position. Three sides of the hour hand 11, the minute hand 12, and the second hand 13 are fixed on the center of the timer display device that rotates through the mechanical movement to indicate the plurality of time symbols 14 for displaying an actual time. The hour hand 11 is used for displaying the hour of the actual time correspondingly. The minute hand 12 is used for displaying the minute of the actual time correspondingly. The second hand 13 is used for displaying the second of the actual time correspondingly. In the conventional example, the hour hand indicates the center of "1" and "2" of the plurality of time symbols 14 in order to display the hour of the actual time to be between one o'clock and two o'clock. The minute hand indicates "6" of the plurality of time symbols 14 in order to display the minute of the actual time to be thirty minutes. The second hand indicates "10" of the plurality of time symbols 14 in order to display the second of the actual time to be fifty seconds. By way of mentioned above, the actual time in the timer display device can be displayed 1:30:50.

However, the above timer display device is usually machinery that is easy to produce rust due to oxidation. Consequently, the timer display device is unable to display the accurate time that users must adjust the timer display device frequently for displaying the accurate time. Digital clocks and digital watches come with the tide of fashion that includes a counting unit for counting an actual time. The counting unit is made by integrated circuit that can count the accurate time more than mechanical clocks or mechanical watches.

Referring to FIG. 2, a block diagram of another conventional timer display device is illustrated. The timer display device at least comprises a plurality of hour display units 21, a plurality of minute display unit 22, a plurality of second display units 23, and a counting unit for counting actual time. Normally, hour display units 21, minute display units 22, and second display units use backlighted Liquid Crystal Display (LCD) or reflecting LCD technology. These technologies are also incorporated the counting unit to count the actual time that uses liquid crystals to be light valves in order to adjust the brightness of backlighted or reflecting. The adjustment results could display the actual time correspondingly.

Referring to FIG. 3, illustrates a block diagram of time displaying of a timer display device according to FIG. 2. In the conventional example, the actual time is 1:30:50 that the plurality of hour display units 21 would adjust the brightness that corresponds to display one o'clock. The plurality of minute display units 22 would adjust the brightness that corresponds to display thirty minutes. The plurality of second display units 23 would adjust the brightness that corresponds to display fifty seconds. By way of the hour display units 21, the minute display units 22, and the second display units 23, the timer display device could display 1:30:50.

Though the timer display device in FIG. 3 could display the accurate time, users must recognize display units that compose of figures in order to convert figures into an actual time. The usage of the timer display device is not more convenience than the timer display device in FIG. 1 because users can perceive an actual time when the location of the indicator has been seen by users. Those disadvantages must be resolved through a different timer display device that shows the light generating status to replace conventional indicators for displaying an actual time.

SUMMARY OF THE INVENTION

Therefore, it is a primary object to provide a timer display device. The timer display device comprises a counting unit and at least twelve light generating modules with circular arrangement to be hour positions. The counting unit is a clock for counting an actual time. The light generating module is to incorporate the counting unit for adjusting a light generating status in order to display the actual time correspondingly. The light generating module further comprises a red light component, a green light component, and a blue light component. The light generating status of the light generating module is composed of the brightness of the red light component, the brightness of the green light component, and the brightness of the blue light component. The brightness of the red light component is to display the hour of the actual time correspondingly. The brightness of the green light component is to display the minute of the actual time correspondingly. The brightness of the blue light is to display the second of the actual time correspondingly. Accordingly, by providing a timer display device having light generating modules with circular arrangement, problems in conventional timer display devices can be resolved that users could perceive the actual time easily by adjusting of the light generating status of light generating modules

DETAILED DESCRIPTION OF THE PREFERRED EMBODIMENTS

To make it easier for our examiner to understand the objective of the invention, its innovative features and performance, a detailed description and technical characteristics of the present invention are described together with the drawings as follows.

Figure 1:
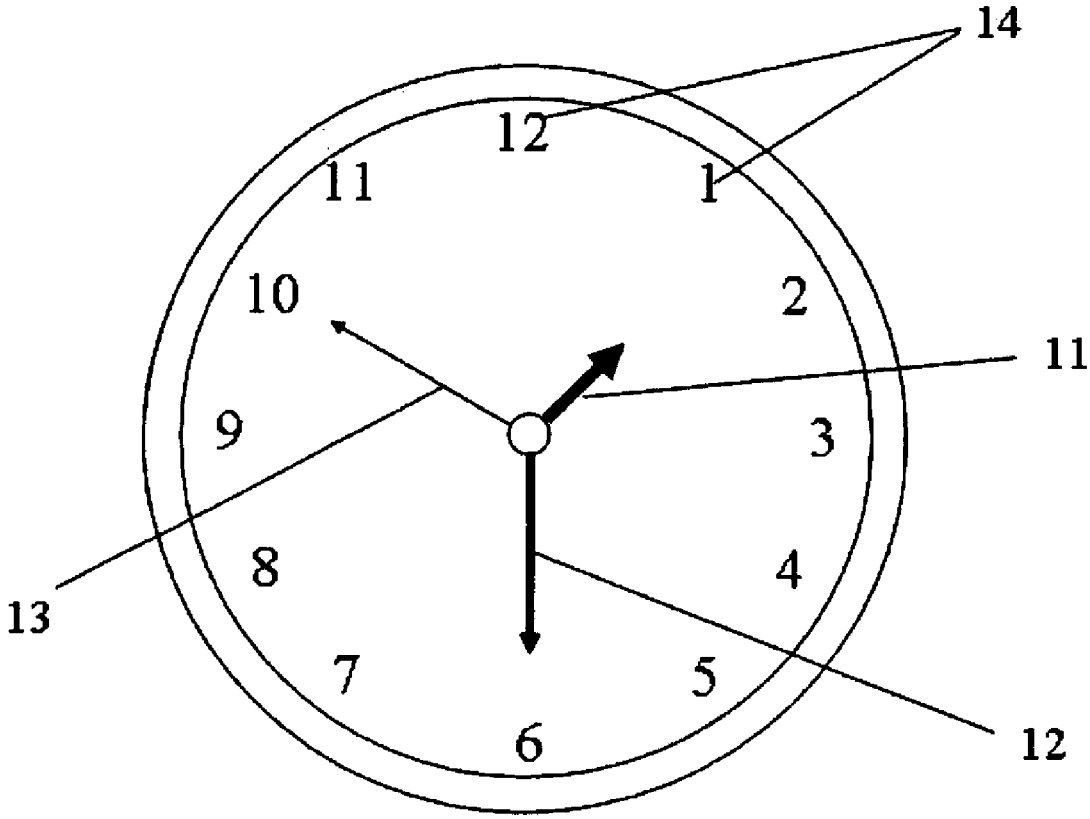
FIG. 1 is a conventional timer display device.
Figure 2:
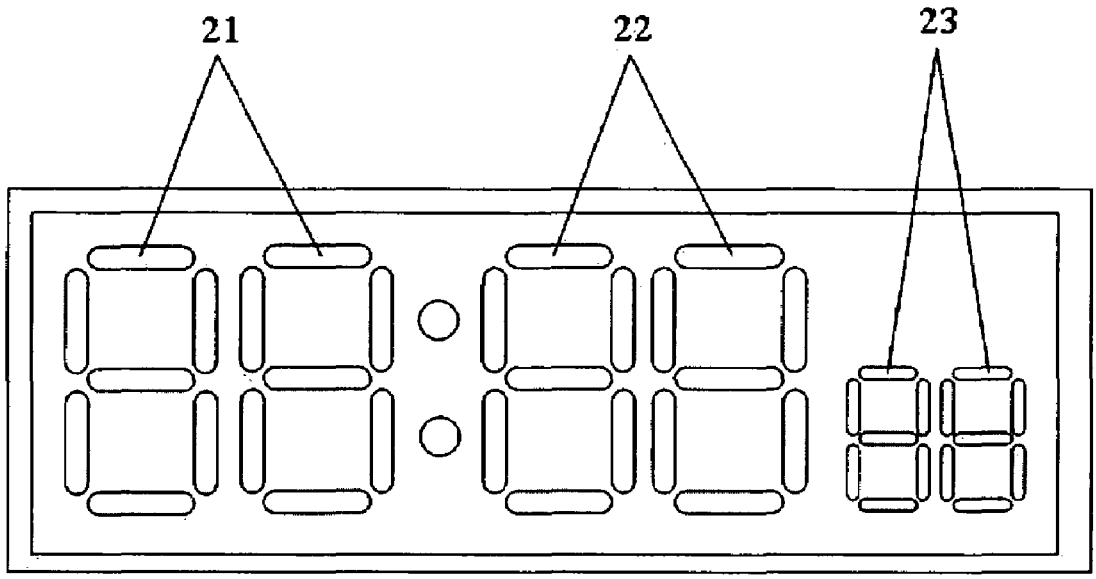
FIG. 2 is another conventional timer display device.
Figure 3:
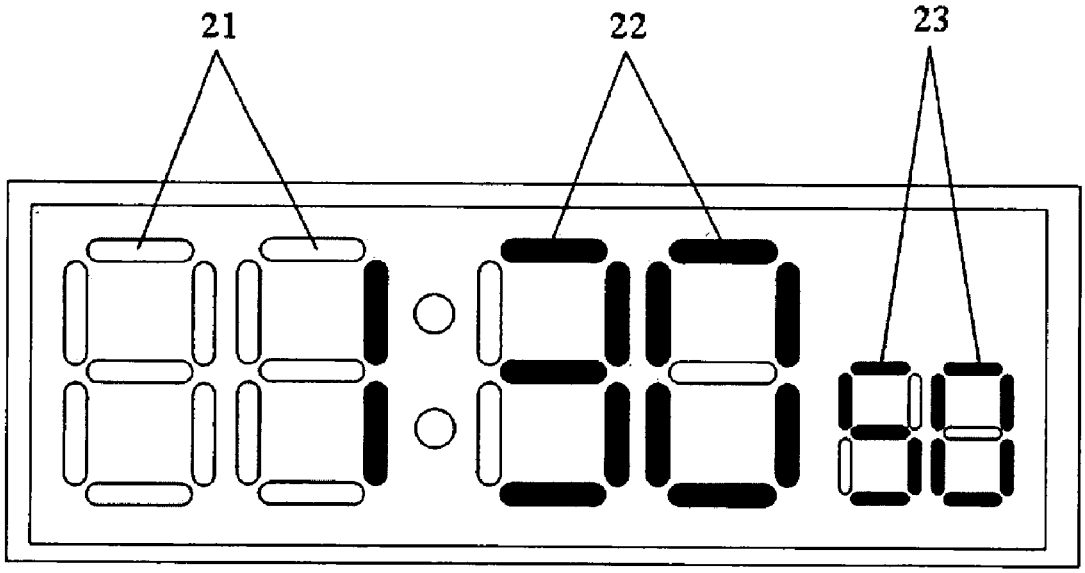
FIG. 3 is a block diagram of time displaying of a timer display device according to FIG. 2.
Figure 4:
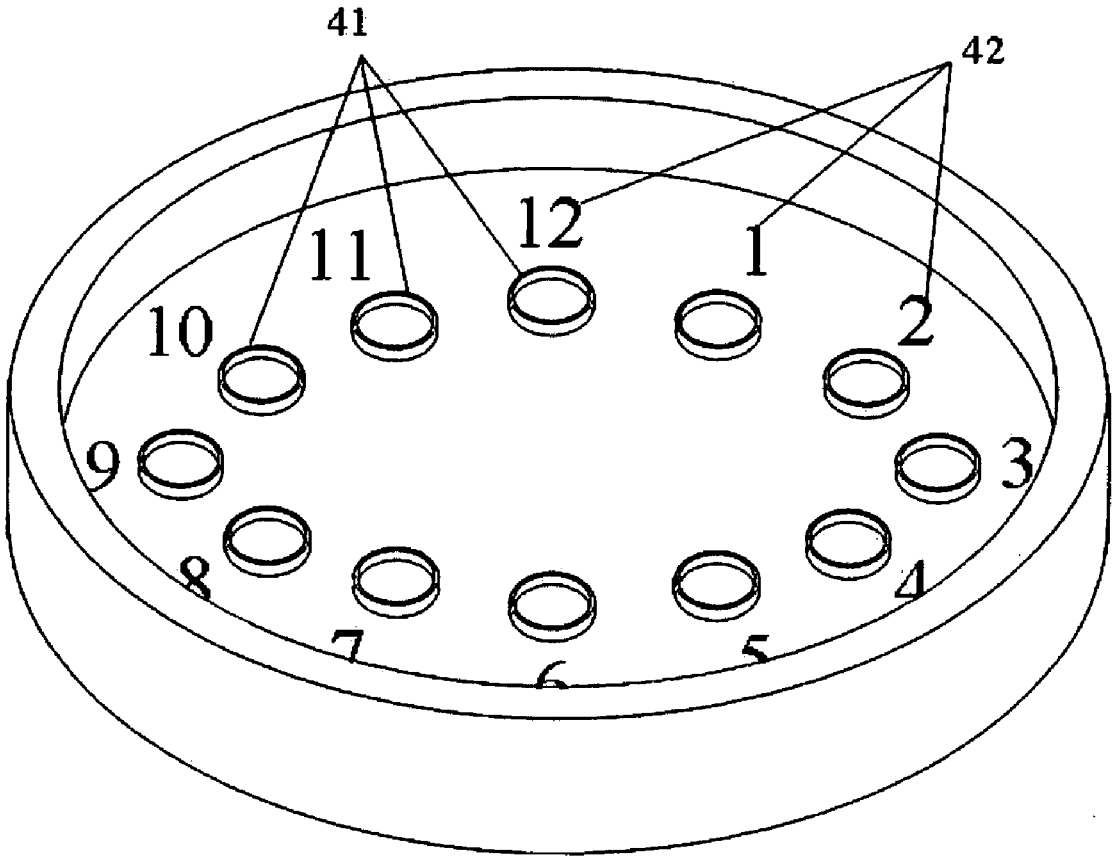
FIG. 4 is a block diagram of an example of a timer display device.

Referring to FIG. 4, a block diagram of an example of a timer display device is illustrated. The timer display device comprises a counting unit and at least twelve light generating modules 41 with circular arrangement to hour position, wherein the hour position indicates ciphers of "1, 2, . . . , 12". The timer display device further comprises twelve timing symbols 42 that arranges in circular to be hour positions in order to take the light generating module 41 to display the hour position. The counting unit is a clock for counting an actual time. The light generating module 41 is to incorporate the counting unit to adjust a light generating status of the light generating module in order to display the actual time correspondingly.

Figure 5:
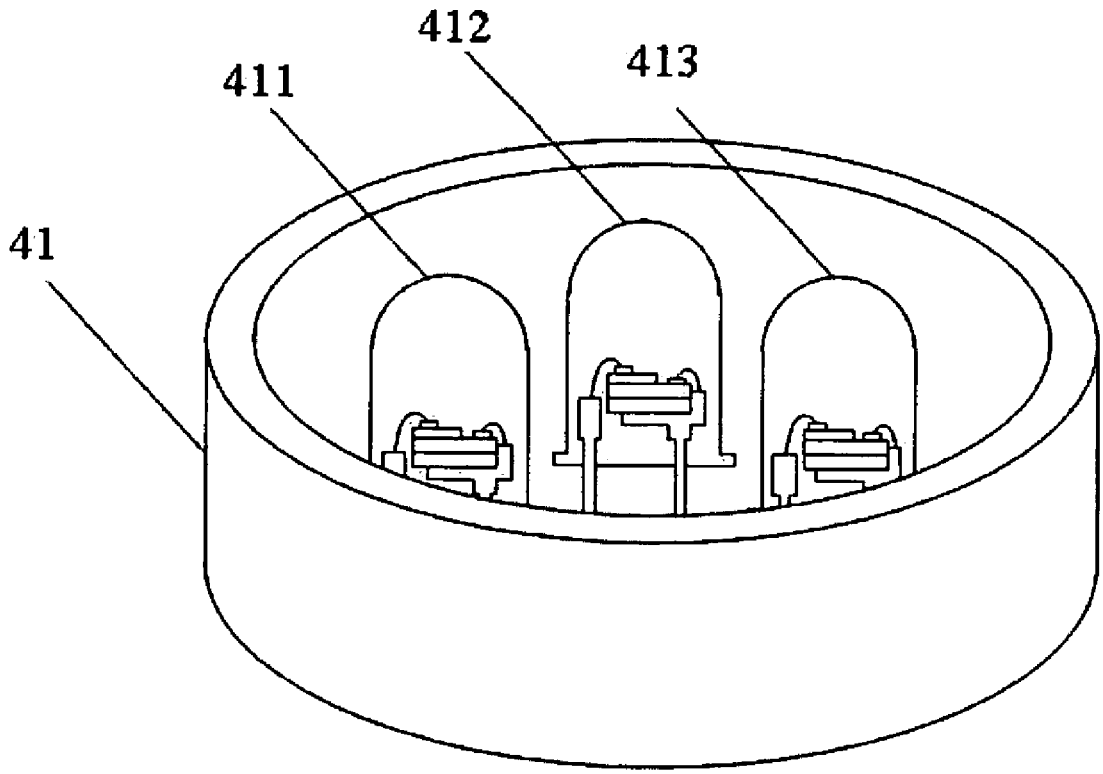
FIG. 5 is a magnified block diagram of an example of a light generating module of a timer display device according to FIG. 4.

Referring to FIG. 5, illustrates a magnified block diagram of an example of a light generating module of a timer display device according to FIG. 4. The light generating module 41 further comprises a red light component 411, a green light component 412, and a red light component 413. The red light component 411 can be a red Light Emitting Diode (LED) for radiating red light. The green light component 412 can be a green LED for radiating green light. The blue light component 413 can be a blue LED for radiating blue light. In addition, the light generating status of the light generating module 41 is composed of the brightness of the red light component 411, the brightness of the green light component 412, and the brightness of the blue light component 413. The red light component 411, the green light component 412, and the blue light component 413 also cooperate with the counting unit to adjust the light generating status in order to display the actual time correspondingly. In the preferred embodiment, for example, the brightness of the red light component, the brightness of the green light component, and the brightness of the blue light component are corresponded to display the actual time of an hour, a minute, and a second individually.

Figure 6:
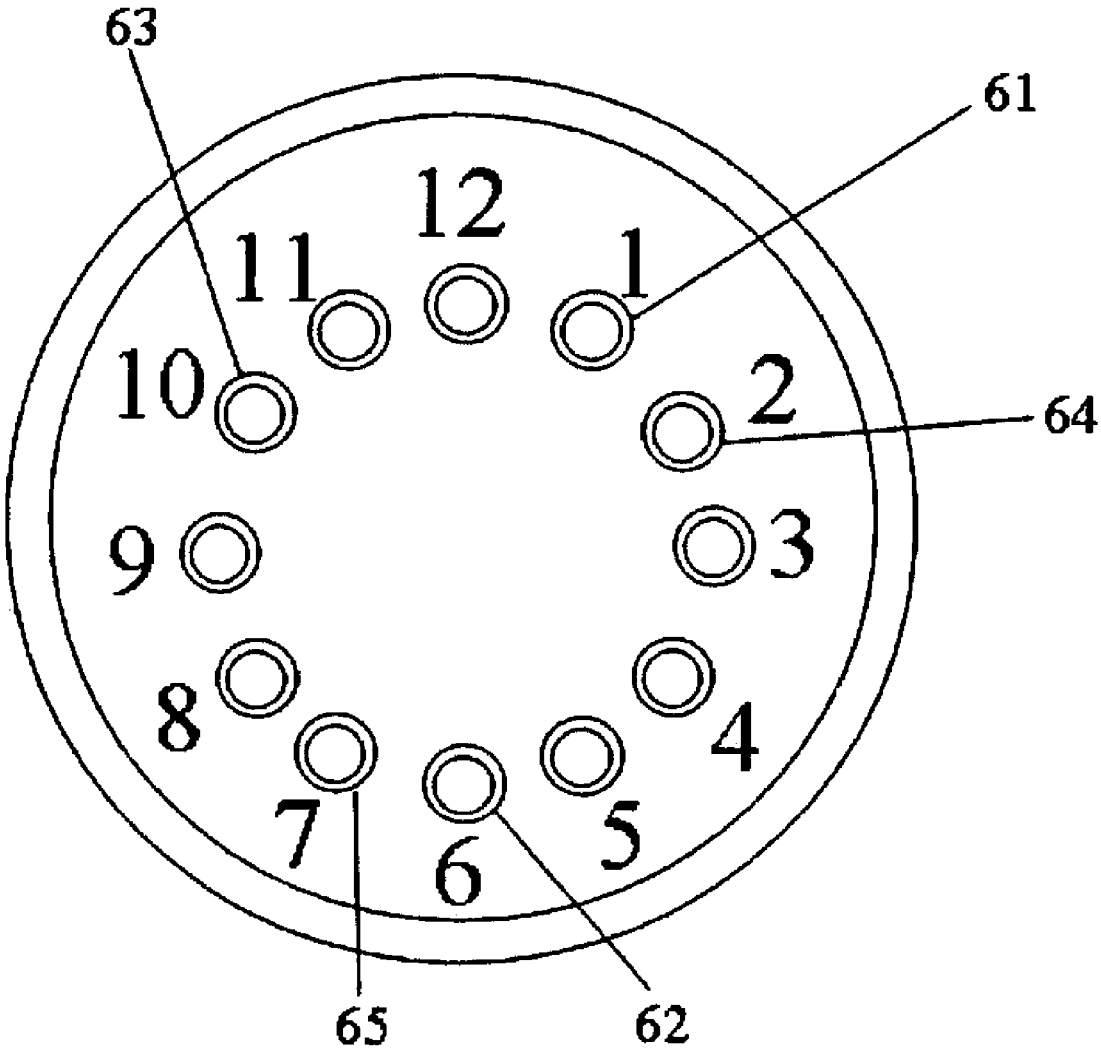
FIG. 6 is a front view of an example of a timer display device according to FIG. 4.

Referring to FIG. 6, illustrates a front view of an example of a timer display device according to FIG. 4. When the actual time is 1:30:50, for example, the red light component of the light generating module 61 of the corresponding hour position "1" would adjust the brightness of the red light component to reach maximum brightness. Users can perceive the actual time of current hour that is one o'clock. Next, the green light component of the light generating module 62 of the corresponding hour position "6" would adjust the brightness of the green light component to reach maximum brightness. Users can perceive the actual time of current minute that is thirty minutes. Third, the blue light component of the light generating module 63 of the corresponding hour position "10" would adjust the brightness of the blue light component to reach maximum brightness. Users can perceive the actual time of current second that is fifty seconds. Finally, users combine above information to know the actual time as the 1:30:50. The 1:30:50 can be displayed as following. The minute is thirty minutes that shows the time between the hour position "1" and the hour position "2" and the red light component of light generating modules 61, 64 of corresponding hour positions "1", "2" would adjust the brightness to reach half brightness. Users could perceive the actual time of the hour that is between one and two o'clock. The red light component of light generating modules 61, 64 would further adjust the degree of the brightness. The red light component of the light generating module 61 adjusts the brightness to be darker and the red light component of the light generating module 64 adjusts the brightness to be brighter for presenting time modifications when the actual time approaches to the two o'clock. The green light component of light generating modules 62, 65 of corresponding hour positions "6", "7" would adjust the brightness at the same time. Users could perceive the minute of the actual time that is between the thirty minutes and the thirty-five minutes. The green light component of the light generating module 62 is brighter than the green light component of the light generating module 65. Users could perceive the minute of the actual time that is quite near the thirty minutes. The green light component of the light generating module 62 adjusts the brightness to be darker and the green light component of the light generating module 65 adjusts the brightness to be darker when the actual time approaches to the thirty-five minutes. The operating principles can be also applied to the blue light component for displaying the second of the actual time.

Figure 7:
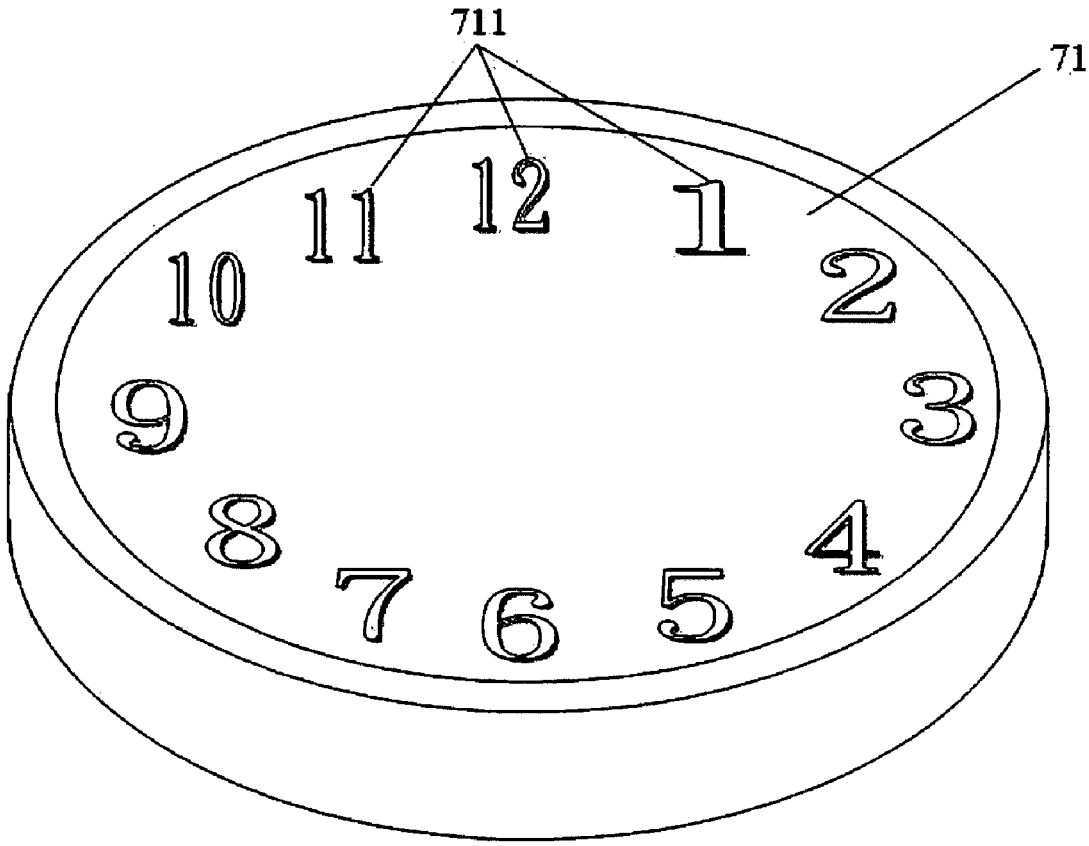
FIG. 7 is another block diagram of an example of a timer display device.
Figure 8:
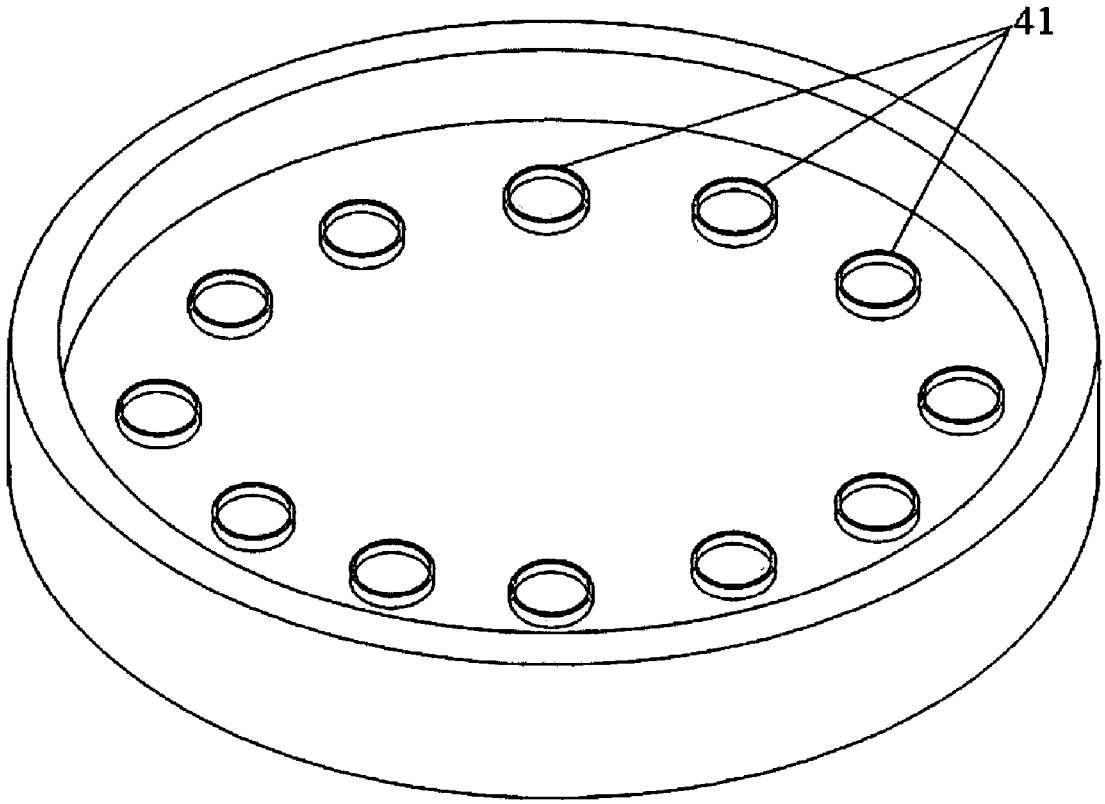
FIG. 8 is an extended block diagram of an example of a timer display device according to FIG. 7.

Referring to FIG. 7, another block diagram of an example of a timer display device is illustrated. The timer display device at least comprises a time panel 71 having twelve time symbols 771 with transparency that arranges in circular to hour positions on the time panel 71. The underside of time symbols 711 can further set the light generating module 41 of mentioned above, as shown in FIG. 8. The actual time can be displayed through corresponding time symbols 711.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the description above, the present invention is novel and useful and definite enhances the performance over the conventional structure and further complies with the patent application requirements and is submitted to the Patent and Trademark Office for review and granting of the commensurate patent rights.

What is claimed is:

1. A timer display device, comprising:

a counting unit for counting an actual time; and at least twelve light generating modules arranged in a circular fashion in accordance with hour positions at the timer display device, said counting unit adjusting a light generating status of each of said at least twelve light generating modules to display said actual time, said each light generating module including a red light component for identifying an hour constituent portion of said actual time, a green light component for identifying a minute constituent portion of said actual time, and a blue light component for identifying a second constituent portion of said actual time, wherein, when said hour constituent portion of said actual time progresses between a first and a second sequential hour positions, a first brightness of said red light component of a first respective light generating module corresponding to said first hour position diminishes, while a second brightness of said red light component of a second respective light generating module corresponding to said second hour position increases, said first brightness reaching a predetermined low level thereof and said second brightness reaching a maximum thereof when said hour constituent portion of said actual time reaches said second hour position, wherein, when said minute constituent portion of said actual time progresses between a third and a fourth sequential hour positions, a third brightness of said green light component of a third respective light generating module corresponding to said third hour position diminishes, while a fourth brightness of said green light component of a fourth respective light generating module corresponding to said fourth hour position increases, said third brightness reaching a predetermined low level thereof and said fourth brightness reaching a maximum thereof when said minute constituent portion of said actual time reaches said fourth hour position, and wherein, when said second constituent portion of said actual time progresses between a fifth and a sixth sequential hour positions, a fifth brightness of said blue light component of a fifth respective light generating module corresponding to said fifth hour position diminishes, while a sixth brightness of said blue light component of a sixth respective light generating module corresponding to said sixth hour position increases said fifth brightness reaching a predetermined low level thereof and said sixth brightness reaching a maximum thereof when said second constituent portion of said actual time reaches said sixth hour position.

2. The timer display device of claim 1, wherein said counting unit is a clock.

3. The timer display device of claim 1, wherein said hour position indicates locations of twelve ciphers.

4. The timer display device of claim 1, wherein said light generating status is composed of the brightness of said red light component, the brightness of said green light component, and the brightness of said blue light component.

5. The timer display device of claim 4, wherein said brightness of said red light component is to display an hour of said actual time.

6. The timer display device of claim 4, wherein said brightness of said green light component is to display a minute of said actual time.

7. The timer display device of claim 4, wherein said brightness of said blue light component is to display a second of said actual time.

8. The timer display device of claim 1, wherein said red light component is a red LED.

9. The timer display device of claim 1, wherein said green light component is a green LED.

10. The timer display device of claim 1, wherein said blue light component is a blue LED.

* * * * *